United States Patent [19]

Ekman et al.

[11] 4,310,364

[45] Jan. 12, 1982

[54] EMULSION EXPLOSIVE SENSITIVE TO A DETONATOR

[75] Inventors: Gunnar O. Ekman; Lars A. Granlund, both of Nora, Sweden

[73] Assignee: Nitro Nobel AB, Gyttorp, Sweden

[21] Appl. No.: 109,234

[22] Filed: Jan. 3, 1980

[30] Foreign Application Priority Data

Jan. 15, 1979 [SE] Sweden ..... 7900326

[51] Int. Cl.[3] ..... C06B 45/00

[52] U.S. Cl. ..... 149/2; 149/55; 149/56; 149/57; 149/67; 149/69; 149/105; 149/106; 149/107

[58] Field of Search ..... 149/2, 55–57, 149/46, 67, 61, 69, 105–107

[56] References Cited

U.S. PATENT DOCUMENTS 4,141,766 2/1979 Cameron et al. ..... 149/38 X
4,149,916 4/1979 Wade ..... 149/56
4,149,917 4/1979 Wade ..... 149/56

*Primary Examiner*—Stephen J. Lechert, Jr.
*Attorney, Agent, or Firm*—Hane, Roberts, Spiecens & Cohen

[57] ABSTRACT

Emulsion explosive sensitive to a detonator, which can be initiated with a conventional detonator no. 8, of water-in-oil-emulsion type containing sensitizers which, as opposed to types known previously, here comprise aromatic nitro-compounds, in which emulsion the organic phase consists primarily of the aromatic nitro-compounds and the water phase consists primarily of a water solution of inorganic oxidizing salts and in which emulsion emulsifier is also included; detonation stabilizers in the form of particles with enclosed or adsorbed gas ("hot spots"); additional fuels such as aluminium, urea, etc.; optional stabilizers for the organic phase and for the water phase; and possibly an agent to lower the crystallization point.

9 Claims, No Drawings

EMULSION EXPLOSIVE SENSITIVE TO A DETONATOR

FIELD OF THE INVENTION

The present invention relates to an emulsion explosive sensitive to a detonator, of the water-in-oil type with "hot spots" in the form of particles with gas enclosed or adsorbed therein.

PRIOR ART

The concept of "hot spots" was introduced by Bowden and colleagues (Proc. R. Soc. A. 188, 1947a and b) and applies here to hot spots in the explosive which acquire a temperature considerably in excess of the temperature in the rest of the explosive.

The expression "sensitive to a detonator" should be understood here to mean that the explosive is initiated by a conventional no. 8 detonator, i.e. a detonator containing an explosive charge equivalent to 2.0 gram quick silver fulminate.

Explosives of the water-in-oil-emulsion type generally contain one or more oxidizing salts, such as ammonium nitrate; an oil and/or a wax; possibly other fuels such as urea, aluminium, etc.; emulsifier; possibly stabilizers for the emulsion, such as guar rubber; and gas bubbles or gas in closed cells.

Explosives of the water-in-oil-emulsion type are described in U.S. Pat. No. 3,447,978. The patent covers emulsions of the water-in-oil type which cannot be initiated by a conventional no. 8 detonator.

U.S. Pat. No. 3,674,578 describes emulsions of water-in-oil type. The sensitivity has been obtained by dissolving in the water phase salts of organic nitrogen bases with inorganic oxidizing acids and mixing gas bubbles into the emulsion.

U.S. Pat. No. 3,715,247 relates to water-in-oil emulsions sensitive to a detonator and containing detonation catalysts consisting of water-soluble oxides/salts of certain metals. The emulsions also contain salts of organic nitrogen bases with nitric acid or inorganic perchlorates as well as enclosed gas or gaseous material.

U.S. Pat. No. 3,765,964 describes water-in-oil emulsions sensitive to a detonator and containing strontium ions as detonation catalysts. The emulsions also contain salts of organic nitrogen bases with nitric acid and/or inorganic perchlorates as well as enclosed gas or gaseous material.

Swedish patent application No. 7708851-6 describes water-in-oil emulsions sensitive to a detonator, which do not have any special sensitizer.

Swedish patent application No. 7714611-6 describes explosive compositions containing at least one oxidizing salt, a solvent, dispergent or carrier for the salt and an aliphatic mono-nitrate as a sensitizer, in which the liquid mono-nitrate is emulsified with the solvent, dispergent or carrier for the inorganic oxidizing salt.

SUMMARY OF THE INVENTION

U.S. Pat. No. 4,008,108 describes a method of chemically producing gas bubbles which are necessary for stable detonation.

According to the present invention it has been found surprisingly that emulsions in which a water solution of organic nitrates and urea is emulsified, using conventional emulsifiers, in partially nitrated aromatic substances, can be initiated by a conventional no. 8 detonator. The nitrated aromatic substances thus constitute the continuous organic phase in these emulsions. Fine-grained inorganic material with air enclosed is used as a detonation stabilizer and co-emulsifier.

Despite the use of extremely efficient emulsifying equipment, equivalent compositions in which the salt solution has been emulsified in a wax and/or mineral oil have been impossible to initiate with conventional no. 8 detonators. However, even with the use of conventional mixers with low speed (120–200 r.p.m.) emulsions have been produced according to the invention which could be initiated and were detonation stable in plastic tubes having a diameter of as little as 17 mm.

The inorganic oxidizing salts included in the water solution (water phase) used in the emulsions consists preferably of ammonium nitrate, sodium nitrate, potassium nitrate an calcium nitrate. Inorganic perchlorates can also be used as oxidizing salts. Water-soluble fuels such as urea are also included in the water solution.

The organic phase consists of sensitizers in the form of aromatic nitro-compounds such as mono-, di- and tri-nitrotoluenes, mono-nitrobenzene, di-nitrobenzenes, mono- and di-nitroxylenes and mixtures of two or more of said nitro-compounds. By mixing various nitro-aromatic substances the melting point of the organic phase can be varied so that varying consistencies can be obtained for the finished emulsion explosive. A surface-active agent with low HLB value (HLB=hydrophile-lipophile balance) is used as an emulsifier, such as sorbitane mono-oleate having an HLB value of 4.3 and sorbitane mono-stearate having an HLB value of 4.7.

Aluminum powder may be included in the emulsion explosive as an additional fuel.

Detonation stabilizers which can be used are, for instance, microspheres B15/250 and C15/250 from 3M Company and Q-cell 200 and 300 from PQ-Corporation. Another fine-grained inorganic material with air enclosed or adsorbed therein which can be used is, for instance, expanded perlite (pearlite, granular pearlite).

The emulsions can be given increased stability by introducing various thickeners into the different phases. The organic phase can be thickened/gelled with cellulose nitrate, for instance, and the water phase with various water soluble thickeners such as guar rubber and xanthane rubber.

DESCRIPTION OF PREFERRED EMBODIMENTS

The invention is illustrated by the following examples:

EXAMPLE 1

A solution consisting of

| | | |
|---|---|---|
| 40 parts by weight | water | Water phase |
| 335 parts by weight | ammonium nitrate | |
| 100 parts by weight | sodium nitrate | |

-continued

| | | |
|---|---|---|
| 400 parts by weight | calcium nitrate TQ (Norsk Hydro) /$NH_4NO_3 \cdot 5\ Ca(NO_3)_2 \cdot 10\ H_2O$/ | (Salt solution) |
| 50 parts by weight | urea | |

was heated to 90° C. After that was added 30 parts by weight microspheres B15/250.

A separate mixture was made of

| | | |
|---|---|---|
| 148 parts by weight | di-nitrotoluene | Organic phase |
| 20 parts by weight | sorbitane mono-oleate | |

and heated to 70° C.

The organic phase was then added to the salt solution while being stirred. After about 5 minutes a water-in-oil-emulsion had been formed.

The explosive was charged into a plastic tube having a diameter of 17 mm and a length of 460 mm. The explosive charge detonated fully when initiated with a no. 8 detonator at +15° C. The density of the explosive was 1150 kg/m$^3$.

EXAMPLE 2

A salt solution (water phase) according to Example 1 was prepared and to this was added 7 parts by weight cellulose nitrate having a nitrogen content of 12.5%.

To the organic phase according to Example 1 was added 10 parts by weight guar rubber.

The salt solution was emulsified with the help of 30 parts by weight microspheres and 20 parts by weight emulsifier (sorbitane mono-oleate) in the manner described in Example 1, whereupon the cellulose nitrate went over to and thickened the organic phase and the guar rubber was dissolved in and thickened the water phase.

The explosive was initiated with a no. 8 detonator and detonated at a velocity of 3600 m/s in a plastic tube having an inner diameter of 32 mm. The density of the explosive was 1140 kg/m$^3$.

EXAMPLE 3

A salt solution in accordance with Example 1, heated to 85° C. and to which had been added 30 parts by weight microspheres, was emulsified in a mixture of 75 parts by weight di-nitrotoluene
75 parts by weight tri-nitrotoluene
20 parts by weight sorbitane mono-oleate which had been heated to 80° C.

The explosive detonated fully in a plastic tube having a diameter of 25 mm. The density of the explosive was 1130 kg/m$^3$.

EXAMPLE 4

A solution consisting of

| | | |
|---|---|---|
| 40 parts by weight | water | Water phase (salt solution) |
| 200 parts by weight | ammonium nitrate | |
| 100 parts by weight | sodium nitrate | |
| 435 parts by weight | Calcium nitrate TQ (Norsk Hydro) | |
| 50 parts by weight | Urea | |

was heated to 83° C. Thereafter was added 30 parts by weight microspheres B15/250.

A separate mixture was then prepared of

| | | |
|---|---|---|
| 46 parts by weight | di-nitroxylene | Organic phase |
| 102 parts by weight | di-nitrotoluene | |
| 20 parts by weight | sorbitane mono-oleate | |

and heated to 50° C.

The organic phase was then added to the salt solution while stirring. After about 5 minutes a water-in-oil-emulsion had been formed.

The explosive was charged into a plastic tube having a diameter of 32 mm and initiated with a no. 8 detonator. The density of the explosive was 1130 kg/m$^3$ and the detonation velocity was 3700 m/s.

EXAMPLE 5

A solution consisting of 30 parts by weight water
278 parts by weight Calcium nitrate TQ (Norsk Hydro)
604 parts by weight ammonium nitrate
88 parts by weight urea was heated to 82° C. Thereafter was added 30 parts by weight microspheres B15/250.

A separate mixture was then prepared of 100 parts by weight di-nitrotoluene
10 parts by weight sorbitane mono-oleate and heated to 70° C.

The salt solution was then emulsified in the organic phase.

The density of the finished explosive was 1100 kg/m$^3$. It was initiated with a no. 8 detonator in a plastic tube having a diameter of 32 mm.

The examples above are intended only to illustrate the invention and not to limit the scope of the invention. Variations and modifications will be evident to those skilled in the art within the limits defined by the following claims.

We claim:

1. An emulsion explosive of the water-in-oil type which is sensitive to a no. 8 detonator, consisting essentially of:

5–20 percent by weight of an organic phase consisting of aromatic nitro-compounds as a sensitizer, said nitro compounds being selected from the group consisting of mono-, di- and tri-nitro toluenes, mono-nitro benzene, di-nitro benzenes, mono- and di-nitroxylenes and mixtures of said nitro-compounds;

5–18 percent by weight water;

0.5–4 percent by weight of an emulsifier with a hydrophile-lipophile balance less than 7;

1–10 percent by weight of inorganic particles with enclosed or absorbed gas as "hot spots"; and 60–90 percent by weight of inorganic oxidizing salts in the water phase.

2. An emulsion explosive as claimed in claim 1 wherein said oxidizing salts are selected from the group consisting of ammonium nitrate, sodium nitrate and calcium nitrate.

3. An emulsion explosive as claimed in claim 1 comprising urea to lower the crystallization point.

4. An emulsion explosive as claimed in claim 1 comprising cellulose nitrate as a thickener to stabilize the organic phase.

5. An emulsion explosive as claimed in claim 1 comprising guar rubber or xanthane rubber as a thickener to stabilize the water phase.

6. An emulsion explosive as claimed in claim 1 wherein said aromatic sensitizer consists of a mixture of di-nitro toluene and di-nitroxylene.

7. An emulsion explosive as claimed in claim 1 wherein said aromatic sensitizer consists of a mixture of mono-nitro toluene and di-nitro toluene.

8. An emulsion explosive as claimed in claim 1 comprising up to 10% of an additional fuel.

9. An emulsion explosive as claimed in claim 1 comprising a water soluble fuel in said water phase.

* * * * *